United States Patent [19]

Baum

[11] 4,403,638

[45] Sep. 13, 1983

[54] COMBINATION CAMERA BAG

[76] Inventor: Frank Baum, 1030 E. 30th St., Hialeah, Fla. 33013

[21] Appl. No.: 370,304

[22] Filed: Apr. 21, 1982

[51] Int. Cl.[3] ..... A45C 11/38

[52] U.S. Cl. ..... 150/52 J; 190/52

[58] Field of Search ..... 150/52 J; 190/52

[56] References Cited

U.S. PATENT DOCUMENTS

| | | | |
|---|---|---|---|
| 2,960,137 | 11/1960 | Lipsitz | 150/52 J |
| 3,122,225 | 2/1964 | Ward | 190/52 |
| 4,212,377 | 7/1980 | Weinreb | 150/52 J X |
| 4,260,004 | 4/1981 | Domke | 150/52 J X |

*Primary Examiner*—Donald F. Norton

*Attorney, Agent, or Firm*—Ernest H. Schmidt

[57] ABSTRACT

A combination camera bag of flexible fabric comprises two "twin" camera bags, one the mirror image of the other, which are selectively attachable side by side for individual use when only one camera system is needed for a photographic field trip, or for doubled use when two camera systems are required. Each twin bag has a partitioned and cushioned camera and camera accessory insert which can be removed and used either for storage of a camera system or for replacement by still other inserts, selectively, holding other camera systems in storage.

4 Claims, 7 Drawing Figures

COMBINATION CAMERA BAG

This invention relates to camera bags or field bags of the type having cushioned, removable compartmented inserts for the reception and carrying of one or more camera systems.

Use of soft camera bags having an interior cushioned compartment for receiving cameras and other fragile camera accessories such as camera lenses, filters, etc. is known. Such camera bags are designed to accommodate one photographic system, that is, a camera and the particular photographic accessories to be used with that camera. Frequently, however, the serious photographer, whether amateur or professional, owns two or more camera systems, which would heretofore require either one camera bag for each or a very large camera bag capable of carrying two or more cameras and their accessories. If only one camera system was needed for any particular field trip, such a large camera bag would be inconvenient to carry. Even if the un-needed camera and accessories were left behind to reduce weight, the bulky size of the large multi-camera bag would be inconvenient as compared with the use of a single system camera bag.

It is, accordingly, the principal object of this invention to provide a combination camera bag comprising twin single system camera bags that can readily be attached side by side for field use with two camera systems or, when detached or separated from one another, that can be used individually in the field with only one camera and its particular accessories.

A more particular object of the invention is to provide a combination camera bag of the character described the individual twin camera bags of which are mirror images of one another and are provided with a common, separable slide fastener adapted to secure the two bags in side to side relative disposition to provide, when needed, a combination camera bag housing two camera systems.

Another object of the invention is to provide twin camera bags of the character described, each of which has a partitioned and cushioned insert for separately and safely holding a camera and its accessories.

Another object of the invention is to provide a combination camera bag of the character described wherein the partition walls of the inserts are adjustable to accommodate to the size of the camera or camera accessories to be contained for carrying.

Yet another object of the invention is to provide a novel and improved combination camera bag of the character described which will be simple in construction, streamlined in appearance, dependable in its protective performance, and durable in use.

Other objects, features and advantages of the invention will be apparent from the following description when read with reference to the accompanying drawings. In the drawings, wherein like reference numerals denote corresponding parts throughout the several views.

Figure 1:
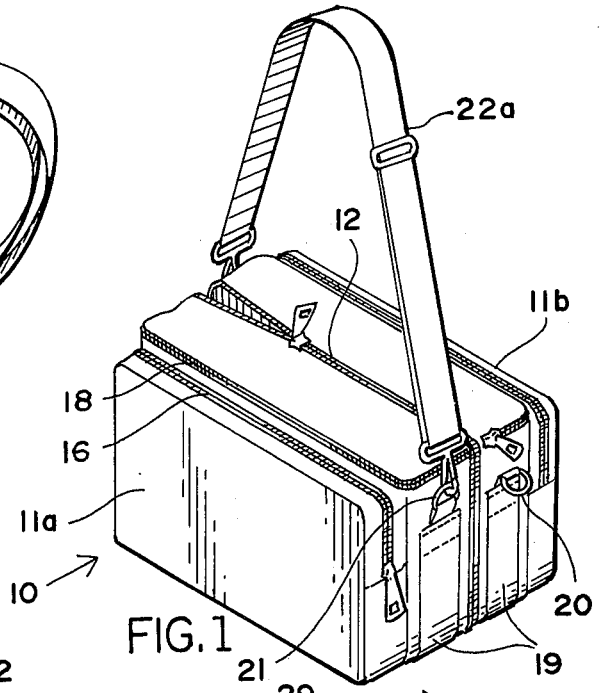
FIG. 1 is an oblique view, as viewed from above, of a combination camera bag employing the invention, showing how a common slide fastener serves to assemble the two complementary camera bags together.

Referring now in detail to the drawings, reference numeral 10 in FIG. 1 designates, generally, a combination camera bag embodying the invention, the same comprising two substantially identical, individually usable camera bags 11*a*, 11*b*, separably attached together by a zipper or slide fastener assembly 12. Since the individual camera bag assemblies 11*a* and 11*b* are identical to the extent that they are mirror images of one another, only the left-hand bag 11*a* is described herein in detail with reference to FIGS. 2 through 7.

Figure 2:
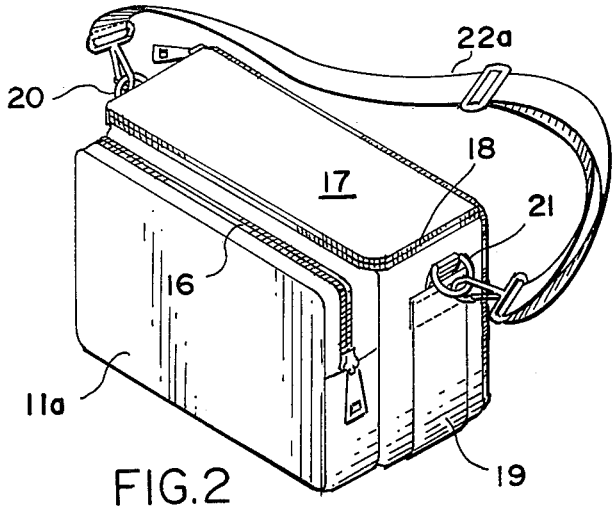
FIG. 2 is an oblique view of one of the two complementary camera bags comprising the camera bag assembly illustrated in FIG. 1, shown separately.
Figure 3:
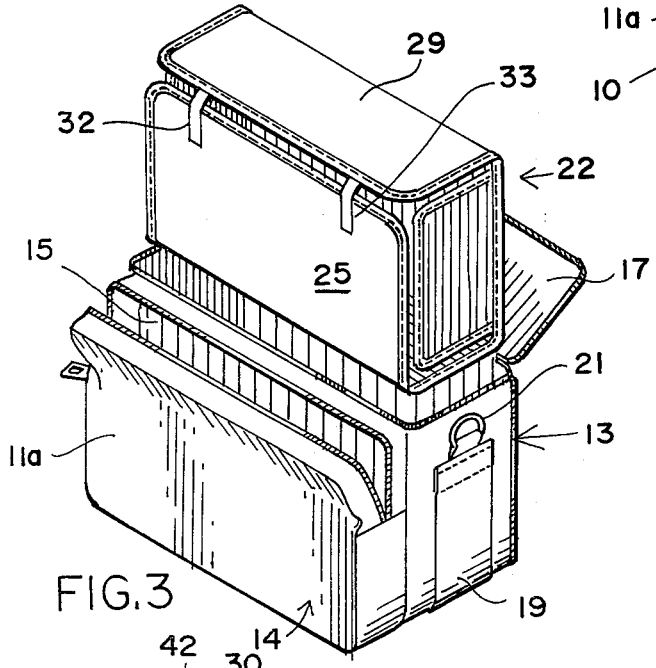
FIG. 3 is a view of the individual camera bag illustrated in FIG. 2, shown with its compartment open and the cushioning camera and camera accessory containing insert withdrawn from the outer case.

As best illustrated in FIG. 3, the individual camera bag 11*a* is fabricated of a flexible, wear-resistant fabric such as a heavy duty, moisture resistant, woven fabric that can readily be sewn for convenience in manufacturing. The camera bag 11*a* comprises a main compartment portion 13 and an auxiliary compartment 14 sewn together at a common side wall or interior divider wall 15. The main compartment portion 13 and auxiliary compartment 14 of the individual camera bag 11*a* are rectangular in shape, with the main compartment portion 13 being approximately twice the lateral thickness or width of the auxiliary compartment portion 14. A slide fastener or zipper 16 extending centrally along the top and partially down each side of the auxiliary compartment portion 14 permits opening and closing of said compartment portion for the insertion and removal of camera supplies such as photographic film. A rectangular top flap 17 sewn along the inside at the top of the main compartment portion 13 can be removably secured in closing relation with respect thereto by slide fastener or a zipper 18. A fabric strap 19 sewn centrally along the underside and partially up the ends of the main compartment portion 13 of the individual camera bag 11*a* terminates in metal hook eyes 20, 21 (only hook eye 21 visible in FIG. 3) to which the snap hooks of an adjustable carrying strap 21*a*, can be attached for hand or shoulder carrying (see FIG. 2).

Figure 4:
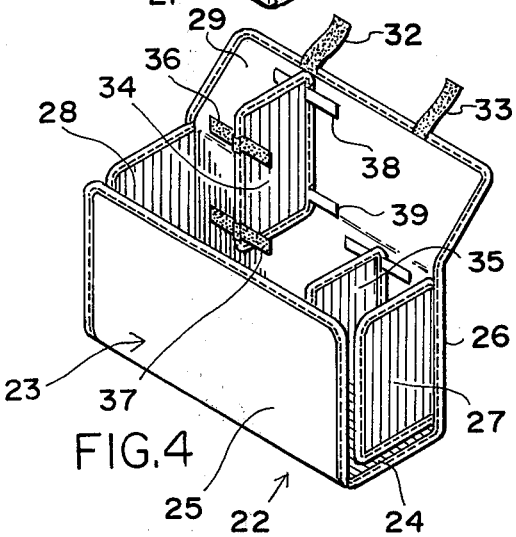
FIG. 4 illustrates, also an oblique view, the camera and accessory insert of FIG. 3, separately and partially open to reveal adjustable interior partitioning.
Figure 7:
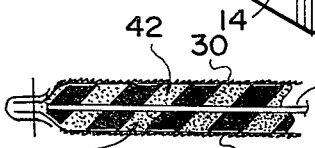
FIG. 7 is a cross-sectional view taken along the plane indicated at 7—7 of FIG. 6 in the direction of the arrows and illustrating constructional details of the insert side walls.
Figure 6:
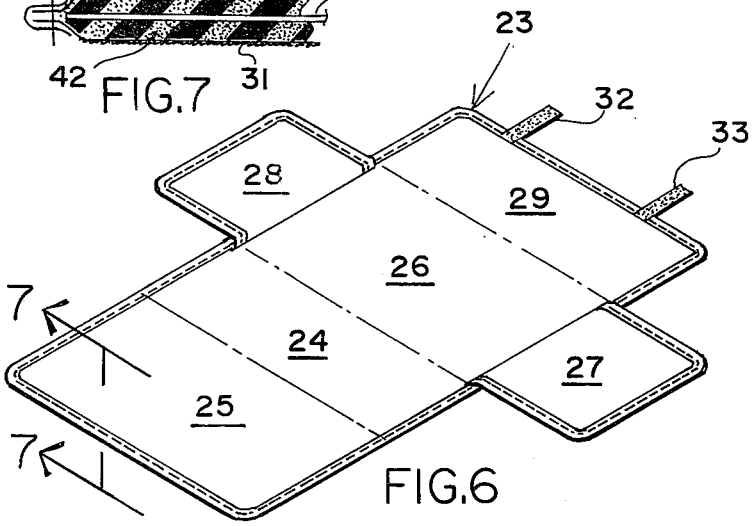
FIG. 6 is a perspective view of the insert illustrated in FIG. 4 shown flat before folding into box-like shape.
Figure 5:
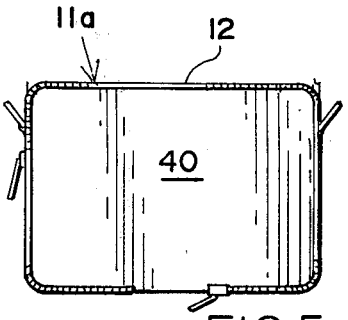
FIG. 5 is a rear elevational view of the camera bag illustrated in FIG. 2.

Removably receivable within the main compartment portion 13 is a rectangular, adjustable, camera and camera accessories container insert assembly 22 having cushioning properties. As best illustrated in FIGS. 4, 6 and 7, the insert assembly 22 comprises a container portion 23 having a bottom wall 24, side walls 25, 26, end walls 27, 28, and a top wall or closure flap 29, all integrally formed of a semi-rigid central panel 41 of cardboard or the like, faced with layers of foam cushion material 42, sandwiched together between fabric coverings 30, 31 sewn together at the lines of juncture along the bottom wall, the end walls, and the top wall, as indicated by the broken line representation thereof in FIG. 6. Such one piece fabrication of the container portion 23 permits folding together or "setting up" into a rectangular container of such shape and size as to be received snugly within main compartment portion 13 of either one of the individual camera bags 11*a*, or 11*b*. The fabric covering layers 30, 31, at the inside and the outside, respectively, of the container portion 23 are of a soft, fine, wool-like material to which the miniature hooks or burrs of pressure-sensitive VELCRO strips will adhere. Thus, as illustrated in FIGS. 3 and 4, a pair of VELCRO hook or burr strips 32, 33 secured at one end in spaced relation along the free, longitudinal edge of the top wall or closure flap 29, serve to releaseably attach said top wall with respect to side wall 25.

Means is provided for dividing the interior of the insert container portion 23 into a plurality of compartments of adjustable size to snugly accommodate cameras and camera accessories, such as lenses of various sizes and shapes. To this end, a plurality of separable partition wall members 34, 35 (only two illustrated and described herein by way of example) are provided, partition wall members being of substantially the same height and transverse width as the "set-up" or folded insert assembly container portion 23. Partition wall members 34, 35 are preferably fabricated of the same materials as those of the container portion 23, so as to be somewhat flexible while at the same time having sufficient resiliency along the outer surfaces to provide a high degree of cushioning for the cameras and camera accessories to be carried within the partitioned sub-compartments of container insert assembly 22. As best illustrated in FIG. 4, the longitudinal edges of the partition wall members 34, 35 have sewn thereto, in spaced relation along each side, VELCRO hook or burr strips 36, 37, 38 and 39, which are used to releaseably secure said partition wall members at any desired position between the inner surfaces of the container portion 23. It will thus be apparent that the partition wall members 34, 35, etc. can not only be positioned to provide sub-compartments of adjustable size to accommodate any particular size of camera or camera accessories suitable for carrying in the camera bag, but also serve to retain the side walls 25, 26 of the container insert assembly 22 in relatively spaced, parallel disposition, or in the "set-up" position for use.

It is to be further noted that the container insert assembly 22, in addition to being usable in association with camera bag 11*a* or 11*b*, for example, for safely carrying a camera and its accessories, can also be used separately as a storage container for a camera and camera accessories. This feature is particularly advantageous to professional photographers or camera buffs who own several camera, each with its own set of accessories, when only one or two camera systems is to be carried for field use.

The versatility of the combination camera bag herein disclosed is further enhanced by the provision of the two substantially identical camera bags 11*a*, 11*b* which, as illustrated in FIG. 1, can be zippered together to provide a combination bag holding two container insert assemblies 22 for carrying two sets of camera equipment or camera systems. With such combinative use of the camera bags 11*a*, 11*b*, the carrying strap 21*a* will preferably be snap-hooked between opposed hook eyes of the two bags. As is commonly provided for, the carrying strap 21*a* can be adjusted as to length carrying either by hand or over the shoulder.

As illustrated in FIGS. 1 and 2, when requirements are such that only one camera with its set of accessories is needed, the camera bags 11*a*, 11*b* can be separated for individual usage by releasing slide fastener 12.

While I have illustrated and described herein only one form in which my invention can conveniently be embodied in practice, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A camera bag assembly comprising, in combination, a first bag portion of flexible material, a second bag portion of flexible material, said second bag portion being of the same size as and a mirror image of said first bag portion, slide fastener means for securing one side of said first bag portion against the corresponding side of said other bag portion, a pair of substantially rectangular camera bag insert members removably receivable, one each, within said first and second bag portions, said bag insert members each comprising peripheral sidewalls, end walls, a bottom wall, and a top wall, all fabricated of a soft cushioning material serving as padding for contained articles, a plurality of interior partition wall members sub-dividing said bag insert members into a plurality of insert compartments, said partition walls also being fabricated of a soft, pliable and flexible material serving as padding for contained articles.

2. A camera bag assembly as defined in claim 1, wherein each of said camera bag insert members is integrally fabricated of a laminate of high density foam sandwiched between outer coverings of a soft, felt-like fabric.

3. A camera bag assembly as defined in claim 2, including means for releaseably attaching said interior partition wall members to opposed inside zones of said bag insert peripheral sidewalls to provide for changing sizes of said sub-divided insert compartments.

4. A camera bag assembly as defined in claim 3, wherein said interior partition wall member releaseable attachment means is pressure sensitive.

* * * * *